United States Patent [19]

Cade

[11] 4,395,638

[45] Jul. 26, 1983

[54] SELF-CHECKING FLAME FAILURE CONTROL

[75] Inventor: Phillip J. Cade, Winchester, Mass.

[73] Assignee: Electronics Corporation of America, Cambridge, Mass.

[21] Appl. No.: 303,616

[22] Filed: Sep. 18, 1981

[51] Int. Cl.[3] ..... G01J 1/00

[52] U.S. Cl. ..... 250/554; 250/209

[58] Field of Search ..... 250/554, 209, 214 R; 340/578

[56] References Cited

U.S. PATENT DOCUMENTS 4,206,454 6/1980 Schapira et al. ..... 250/554 X

*Primary Examiner*—David C. Nelms
*Assistant Examiner*—Darwin R. Hostetter
*Attorney, Agent, or Firm*—Charles E. Pfund

[57] ABSTRACT

This invention relates to control circuits of the type which continuously monitor their own performance so as to be self-checking, i.e., to produce a response whenever the system shows the absence of a condition being monitored or a change therein and also produces a response if the control system itself should become inoperative or otherwise malfunction.

6 Claims, 1 Drawing Figure

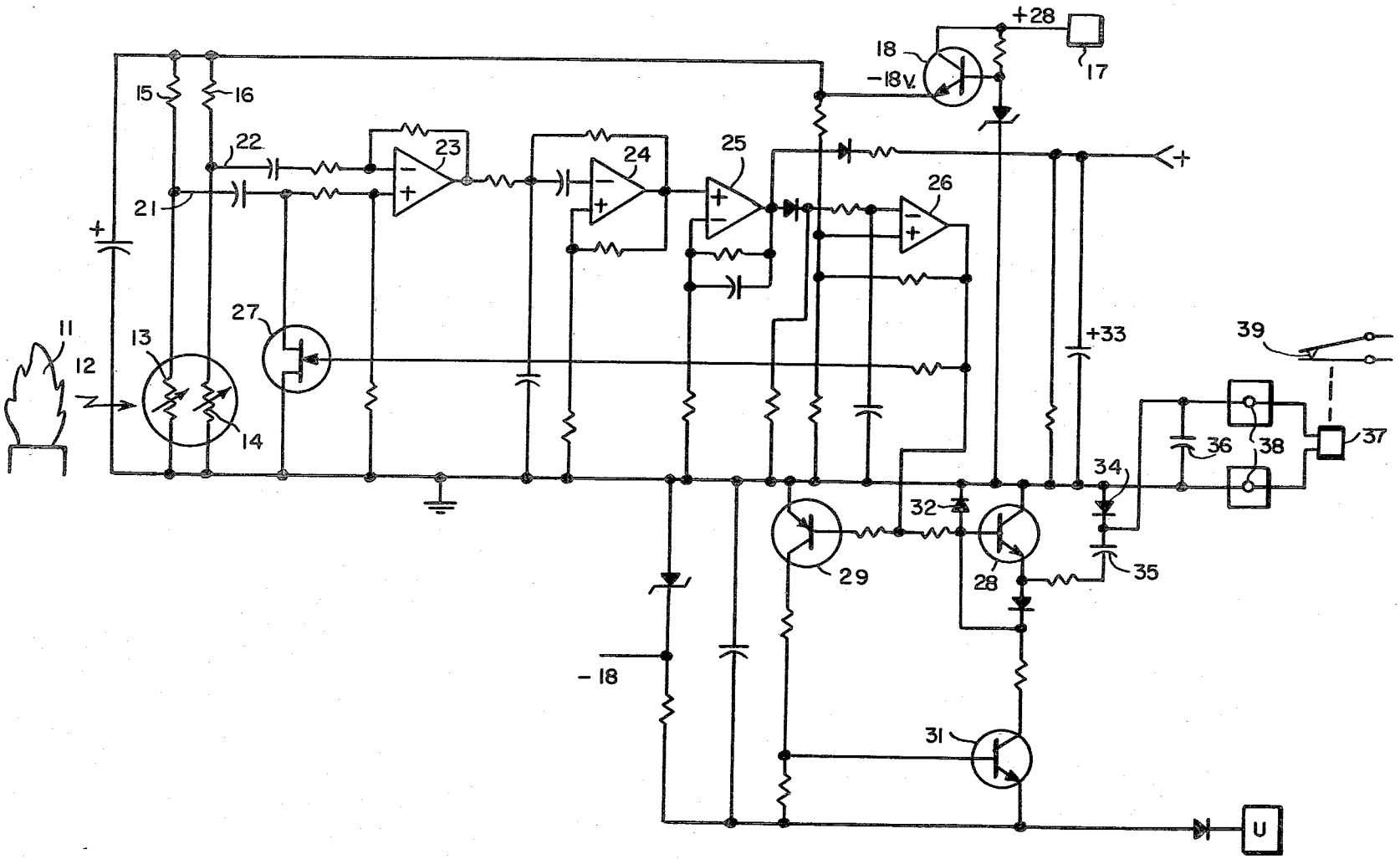
+28
17
18
-18v.
+
+33
26
25
24
23
16
15
22
21
27
13
14
12
11
+
39
37
38
36
34
35
28
32
29
31
U
-18

SELF-CHECKING FLAME FAILURE CONTROL

BACKGROUND OF THE INVENTION

Self-checking control systems have long been known in which an event sensor produces a signal which is monitored and some characteristic is superimposed on the sensor signal such that the monitoring of the superimposed characteristic can detect whether or not the control system is functioning continuously. Thus failure of the event which is being monitored by the sensor or failure of the control circuit itself to maintain the superimposed characteristic both result in a response of the self-checking control system which can be investigated and interpreted as either a failure of the event itself or failure of the circuit system.

Typically, systems of the above-described type have been employed to monitor the burner flame in power plants, particularly large scale industrial installations, where a photoresponsive device is arranged to be energized by the radiant energy from the flame in the firebox. By interposing a mechanical shutter which "chops" the light or radiation energy passing from the flame to the photodetector a modulated signal is obtained whenever a flame is present. By making the system responsive to the modulated signal but capable of causing an alarm or actuating suitable controls upon the absence of modulation the system is capable of responding both to the loss of burner flame or the failure of any of the circuit elements or the mechanical light interrupting device.

Systems of this type can be utilized either for producing an alarm indication or for actuating controls. In the example given where a burner flame is being monitored the occurrence of flame failure results in a signal which both gives an alarm and actuates controls to shut down the fuel supply and otherwise secure the burner system from dangerous or explosive conditions.

To ensure that self-checking control systems are fail-safe the end point for the signal derived by the system is generally applied to energize a control relay during the presence of the modulated signal from the sensor. If the control relay is maintained energized by the receipt of the modulated signal but produces the alarm or the shutdown control functions by becoming deenergized upon failure to receive the modulated signal a further safeguard is achieved in that an ordinary power failure will also deenergize the relay and initiate shutdown.

A simple system used to detect the presence of a condition can fail (due to component failure) in either the direction of showing the presence or absence of the condition. One of these directions may be an unsafe failure mode. In a flame failure control, a failure that indicates a flame when there is no flame is an unsafe failure mode. A failure that indicates no flame even if there is a flame present is a safe failure mode. When a photocell is used to detect radiation from a flame, for instance, it causes passage of photoelectric current. However, a component short circuit can provide the same current flow and, therefore, an absence of flame would not be detected. The same principle is true when a photocell is used to detect the modulation in a flame since the flame sensor can become electrically noisy and simulate a flame. Mechanical self-checking systems are designed to check for component failures by using an electromechanical chopper which allows the sensor a first time interval to lock at a flame when it must show the presence of a flame and a second time interval to interrupt the view of the flame when the sensor must recognize an absence of flame. The self-checking system operates continuously to detect the flame/no flame conditions repetitively. The system is arranged so that it must switch repetitively between signal and no signal conditions in order to maintain the system in operation. Therefore, any failure to switch to the no signal condition or any failure to switch to the signal condition will cause the system to interrupt the power supply to the fuel valve. There are two problems inherent in such self-checking systems. One of these is the mechanical wear leading to limited life of the equipment caused by the shutter continuously operating. The second problem is particularly related to systems that operate from the modulation present in the flame because the operation of the shutter exposes the sensor to alternating conditions of looking at the flame and no flame including the condition of looking at hot refractory in the furnace either with or without a flame present and then having the field of view obstructed by the shutter. This causes a large amount of inherent noise in the system because of the optical changes and leads to oscillations in the amplifier commonly called ringing, which interferes with a proper determination of the signal/no signal condition.

A common system for detecting the presence of flame using the inherent modulation characteristic of the flame itself frequently operates in the region of 10 Hz and it is desired to show a flame failure in less than one second. Therefore, any shutter operation must be for much shorter than one second. It is very difficult to separate the effect of the chopper on the flame signal from the normal 10 Hz modulation characteristic. In other words, the chopping of the light beam used to detect the failure of any component creates signals too close to the characteristic of the flame being used to detect the presence of the flame. The present invention system described eliminates both of these problems because there is no chopper or mechanical line interruption which causes a mechanical wear problem and, since the light beam is not optically interrupted, there are no interfering signals caused by interrupting the light path while the sensor is viewing hot refractory.

SUMMARY OF THE INVENTION

The present invention overcomes certain disadvantages of prior art systems of this type and provides enhanced reliability while simplifying the equipment required to achieve a fully fail-safe self-checking system by eliminating the need for any mechanical moving parts or other form of light chopper or shutter to modulate the light or radiant energy signal which is sensed by the sensor. The same advantage applies to other types of self-checking systems which may sense a wide variety of events other than the presence of radiant energy since the circuit is directly usable with regared to sensor of every type.

Basically, the invention utilizes two sensors capable of sensing the same event and producing two separate but comparable signals indicating the presence of the event and, conversely, the absence of such signal to indicate the absence of the event. These two comparable signals from two sensors when compared produce a comparison output of the presence of the event which output is then used to interrupt the signal from one of the sensors so that the comparison no longer exists. Canceling the existence of the comparison results, of course, in the cancellation of the interruption of the signal from one sensor so that if the event is still present both sensors provide the comparable signals and an affirmative comparison is again made. With this arrangement the circuit alternates between passing both signals from the sensors sensing the same event and interrupting one of the signals so that the output of the comparator is a modulated signal representing affirmative comparison and negation of comparison. This signal corresponds to the modulated signal in the prior art systems which can be utilized in a variety of ways, one of which is to operate a circuit that amplifies the alternations and detects the alternations to obtain the signal for energizing the control relay whenever the alternation signal is detected.

DESCRIPTION OF THE DRAWINGS

The single FIGURE of the drawing shows a schematic wiring diagram of a circuit in accordance with the invention as it would be applied in the simplified burner flame presence detector and control system shown.

DETAILED DESCRIPTION OF THE PREFERRED EMBODIMENT

Referring to the drawing, the circuit is shown located relative to a burner flame 11 or other source of radiant energy 12 which is sensed by two separate similar photodetectors 13 and 14. The photodetectors 13, 14 are respectively in series with resistors 15, 16 which are connected in series across an appropriate DC supply provided from a DC source 17 through regulator 18.

The photodetectors 13, 14 effectively change resistance as indicated upon reception of radiant energy 12 such that the voltage at the junction between photoresistor 13 and resistor 15 and the junction between the photoresistor 14 and resistor 16 both change by a comparable amount as compared to the voltage at such junctions in the absence of radiation 12. Thus comparable signals appear on lines 21 and 22 when the same event, i.e., the presence of flame 11 is sensed by the photodetectors 13, 14.

The comparable signals on lines 21 and 22 are compared in a voltage comparator 23, the output of which is amplified in an operational amplifier 24 and applied to a Schmitt trigger 25. The output of the Schmitt trigger 25 is essentially a squarewave indicating at one level the presence of comparable signals in the comparator 23 received from lines 21 and 22 or the absence of such comparable signals in the comparator 23 as represented by the other state of the output of trigger 25 and is applied to amplifier 26.

The output of amplifier 26 is applied as a control signal to a shunt transistor 27 which is connected to shortcircuit line 21 to ground when transistor 27 conducts. This action thus alternately removes the event sensing signal on line 21 as an input to the plus terminal of comparator 23. With only the signal from the event sensed appearing on line 22 input to the minus terminal of comparator 23 the output of comparator 23 indicates the absence of comparison and the squarewave output of trigger 25 and amplifier 26 reverses polarity and when applied as a control signal to transistor 27 causes it to be non-conductive. When transistor 27 does not conduct both signals on line 22 and 23 can be compared in comparator 23 and if a flame 11 is present the comparison will indicate comparable signals and the affirmative output indicating the presence of the event will be translated through trigger 25 and amplifier 26 to again cause transistor 27 to become conductive. Whenever flame 11 is present this alternation between the affirmation and negation of the comparison will proceed at a rate determined by the time constants of the circuits such that the output of amplifier 26 is a continuous square wave.

When a flame is present the squarewave output of amplifier 26 is applied to the input of a power transistor 28 and through an inverter 29 to the input of another power transistor 31. Power transistors 28 and 31 and thus controlled by out of phase squarewaves such that they alternately conduct and by connection through rectifiers 32, 33 and 34 and capacitors 35 and 36 constitute a voltage doubling circuit for charging capacitor 36. Capacitor 36 is a relatively large capacitance to provide sufficient charge to maintain energized a relay 37 connected across terminals 38 for a period longer than the period of the squarewave energizing the power amplifiers 28 and 31. Thus once an alternating comparison signal from amplifier 26 is present the capacitor 36 will become charged and energize relay 37 to close normally open contacts 39.

In normal burner control systems many complex and interrelated controls are normally used but for the purpose of illustrating the invention only a single set of contacts 39 is illustrated. Contacts 39 are connected to control the burner or indicate burner flame-out whenever contacts 39 are open. Since under normal operation contacts 39 are closed the burner control operates to maintain the flame and the indicators indicate the presence of flame. As previously noted if there should be a power failure relay 37 will deenergize opening contacts 39 to indicate that malfunction.

If burner flame 11 should fail or become so defective as to fail to energize the photodetectors 13, 14, there will be no comparison signal output of comparator 23 nor any altermating signal from amplifier 26 and consequently no voltage across capacitor 36 to maintain relay 37 energized. If the flame should fail once it has established closure of contacts 39 by energizing relay 37, the capacitor 36 will discharge to deenergize relay 37 and produce the desired alarm or control function.

A variety of applications of the invention will now be apparent to those skilled in the art. Similarly, modifications can be made without departing from the scope of the invention described in the appended claims. For example, other sources of the control signal for one of the sensor lines 21, 22, can be used such as an optically coupled switch in place of transistor 27. Also, the interrupted signal line 21 could be interrupted in series or by gating within the comparator 23 or similar such equivalents. It will also be apparent that the invention can be applied to provide an alarm and control function in response to sensing the absence of any event which is suitably monitored by two sensors which produce signals that can be compared. The invention, accordingly, is to be considered as limited only by the scope of the appended claims.

I claim:

1. A solid state self-checking system comprising first and second sensor means for sensing the same event and generating signals which are comparable upon sensing the same event;

signal comparing means responsive to said signals from said first and second sensor means for generating a negation response in the absence of comparable signals and responsive to the presence of said comparable signals for generating a comparison response;

switching means coupled to the output of said signal comparing means for alternately interrupting comparison of said signals in said comparison means in response to said comparison response and restoring comparison in response to said negation response; and utilization means operable in response to the alternating operation of said switching means.

2. A system according to claim 1 wherein said utilization means when operated energizes said system to maintain the presence of said event and deenergizes said system upon absence of said alternating operation of said switching means.

3. The system according to claim 2 in which said system is a burner control system and said event is the presence of normal flame in said burner.

4. The system according to claim 2 in which said event is the normal flame in a said burner, said sensor means are flame detectors sensing flame in said burner and said utilization means deenergizes fuel supply to said burner upon failure to sense flame in said burner.

5. A fail-safe self-checking system comprising:

a pair of sensors each adapted to sense the affirmation or negation of the same event and produce comparable signals representative of the state of the event;

a signal comparator coupled to said sensors for comparing said signals from said sensors;

means responsive to the output of said comparator representing the affirmation comparison of both said signals applied to said comparator for interrupting one of said signals, said means terminating said interrupting upon a failure to maintain said affirmation comparison output; and means responsive to the sustained alternation of presence and absence of comparison output for maintaining said system energized, said means deenergizing said system upon cessation of said alternation.

6. The system according to claim 5 wherein said system is a burner control system, said sensors are flame sensors and said means responsive to the sustained alternation comprises a circuit for detecting said alternations, a time constant circuit, and a relay energized continuously during said alternations by said time constant circuit.

* * * * *